US008056996B2

(12) United States Patent
Koloff, Jr. et al.

(10) Patent No.: US 8,056,996 B2
(45) Date of Patent: Nov. 15, 2011

(54) SUPPORT ASSEMBLY FOR AN APPLIANCE STORAGE BIN OR STORAGE SHELF

(75) Inventors: Phillip Eugene Koloff, Jr., Louisville, KY (US); Ravikiran Gopalakrishna, Andhrapradesh (IN); Mahesh Natarajan, Tamil Nadu (IN); Harsha Shamanna, Andhrapradesh (IN); Paul Douglas Mantle, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1088 days.

(21) Appl. No.: 11/514,613

(22) Filed: Sep. 1, 2006

(65) Prior Publication Data

US 2008/0054772 A1 Mar. 6, 2008

(51) Int. Cl.
*A47B 96/00* (2006.01)

(52) U.S. Cl. ..... 312/404; 312/408

(58) Field of Classification Search ..... 312/330.1, 312/334.1, 334.7, 334.8, 333, 401, 402, 408, 312/228.1, 404; 384/18, 19, 20; 62/382, 62/440

See application file for complete search history.

(56) References Cited

U.S. PATENT DOCUMENTS 4,470,642 A * 9/1984 Gasperin ..... 384/19
4,662,761 A * 5/1987 Hoffman ..... 384/18
6,322,180 B1 11/2001 Hall et al.
6,447,083 B1 9/2002 Chiapetta et al.
6,745,578 B2 6/2004 Collins et al.
6,817,685 B2 * 11/2004 Lammens ..... 312/334.47
6,817,688 B2 11/2004 O'Halloran
6,969,133 B2 * 11/2005 Compagnucci ..... 312/334.6
6,971,730 B2 12/2005 Koons
7,168,578 B2 1/2007 Mersch et al.
2003/0172664 A1 9/2003 Collins et al.
2003/0173882 A1 * 9/2003 Koons ..... 312/404
2005/0093408 A1 * 5/2005 Koloff et al. ..... 312/404
2005/0127683 A1 * 6/2005 Nam ..... 292/96
2006/0033410 A1 2/2006 Koons
2006/0087207 A1 4/2006 Oh et al.
2006/0152119 A1 7/2006 Park
2006/0175273 A1 8/2006 Toomey-Rossow
2006/0266070 A1 11/2006 Ertz et al.
2007/0018548 A1 1/2007 Ertz et al.
2008/0018215 A1 * 1/2008 Carden et al. ..... 312/404

* cited by examiner

*Primary Examiner* — James O Hansen
(74) *Attorney, Agent, or Firm* — Global Patent Operation; Douglas D. Zhang

(57) ABSTRACT

An appliance includes a cabinet having a plurality of cabinet walls defining a compartment, a storage member configured to support an item for storage in the compartment, and a support assembly slidably mounted within the compartment. The support assembly includes a fixed rail mounted to one of the cabinet walls, and a movable rail slidably coupled to the fixed rail and movable along a sliding direction between a retracted position and an extended position. A bracket is slidably mounted to the movable rail and is movable along a sliding direction between a retracted position and an extended position. The sliding direction of the bracket is substantially parallel to the sliding direction of the movable rail. The storage member is fixedly connected to the bracket and movable with the bracket.

18 Claims, 8 Drawing Sheets

SUPPORT ASSEMBLY FOR AN APPLIANCE STORAGE BIN OR STORAGE SHELF

BACKGROUND OF THE INVENTION

This invention relates generally to an appliance storage member, and more particularly, to a support assembly for an appliance storage bin or storage shelf.

Household appliances typically include storage shelves or storage chambers, such as bins, pans, drawers, and the like. It is useful and desirable to the consumer for the storage chambers and storage shelves to be movable for accessing the contents held by the storage chamber or the storage shelf. The storage chambers and storage shelves are generally suspended from a support structure that includes a track or glide that facilitates sliding movement of the storage chamber or storage shelf in and out of the appliance. Some storage chambers are rotatably mounted within the appliance for accessing the contents of the storage chamber.

While slide-out storage chambers and storage shelves are desirable for convenient access, they can be difficult to use. In at least some known appliances, the storage chambers or storage shelves can unexpectedly come all of the way out of its track, spilling the contents of the chamber or shelf. In other appliances, the travel of the storage chambers or storage shelves are limited so that they only come partially out of the compartment of the appliance, which limits access to the contents of the storage chambers and storage shelves. For example, at least some of these known appliances include two slide assemblies, wherein one slide is coupled to the appliance and the other slide is slidable along the fixed slide. These slides require an overlap for stability of the two slides when the movable slide is extended. As such, the storage shelf or storage chamber is not fully extendable which decreases the usability of the storage shelf or storage chamber. To overcome this problem, other known appliances include three slide assemblies. The third slide allows for full extension of the storage shelf or storage chamber. However, three slide assemblies are more expensive than two slide assemblies.

BRIEF DESCRIPTION OF THE INVENTION

In one aspect, an appliance is provided including a cabinet having a plurality of cabinet walls defining a compartment, a storage member configured to support an item for storage in the compartment, and a support assembly slidably mounted within the compartment. The support assembly includes a fixed rail mounted to one of the cabinet walls, and a movable rail slidably coupled to the fixed rail and movable along a sliding direction between a retracted position and an extended position. A bracket is slidably mounted to the movable rail and is movable along a sliding direction between a retracted position and an extended position. The sliding direction of the bracket is substantially parallel to the sliding direction of the movable rail. The storage member is fixedly connected to the bracket and movable with the bracket.

In another aspect, a support assembly is provided for a storage member of an appliance having a cabinet with a plurality of cabinet walls defining a compartment, the storage member configured to store an item in the compartment. The support assembly includes a fixed rail mounted to one of the cabinet walls, a movable rail slidably coupled to the fixed rail and movable along a sliding direction between a retracted position and an extended position, and a bracket slidably mounted to the movable rail and movable along a sliding direction between a retracted position and an extended position. The sliding direction of the bracket is substantially parallel to the sliding direction of the movable rail, and the bracket is configured to support the storage member such that the storage member is movable with the bracket.

In a further aspect, a method is provided of assembling a support assembly for an appliance having a cabinet with a plurality of cabinet walls defining a compartment. The method includes coupling a fixed rail of the support assembly to one of the cabinet walls, slidably coupling a movable rail to the fixed rail, slidably coupling a bracket to the movable rail, and fixedly coupling a storage member to the bracket. The storage member is configured to store an item in the compartment, and the bracket movable along a sliding direction with the bracket.

DETAILED DESCRIPTION OF THE INVENTION

Figure 1:
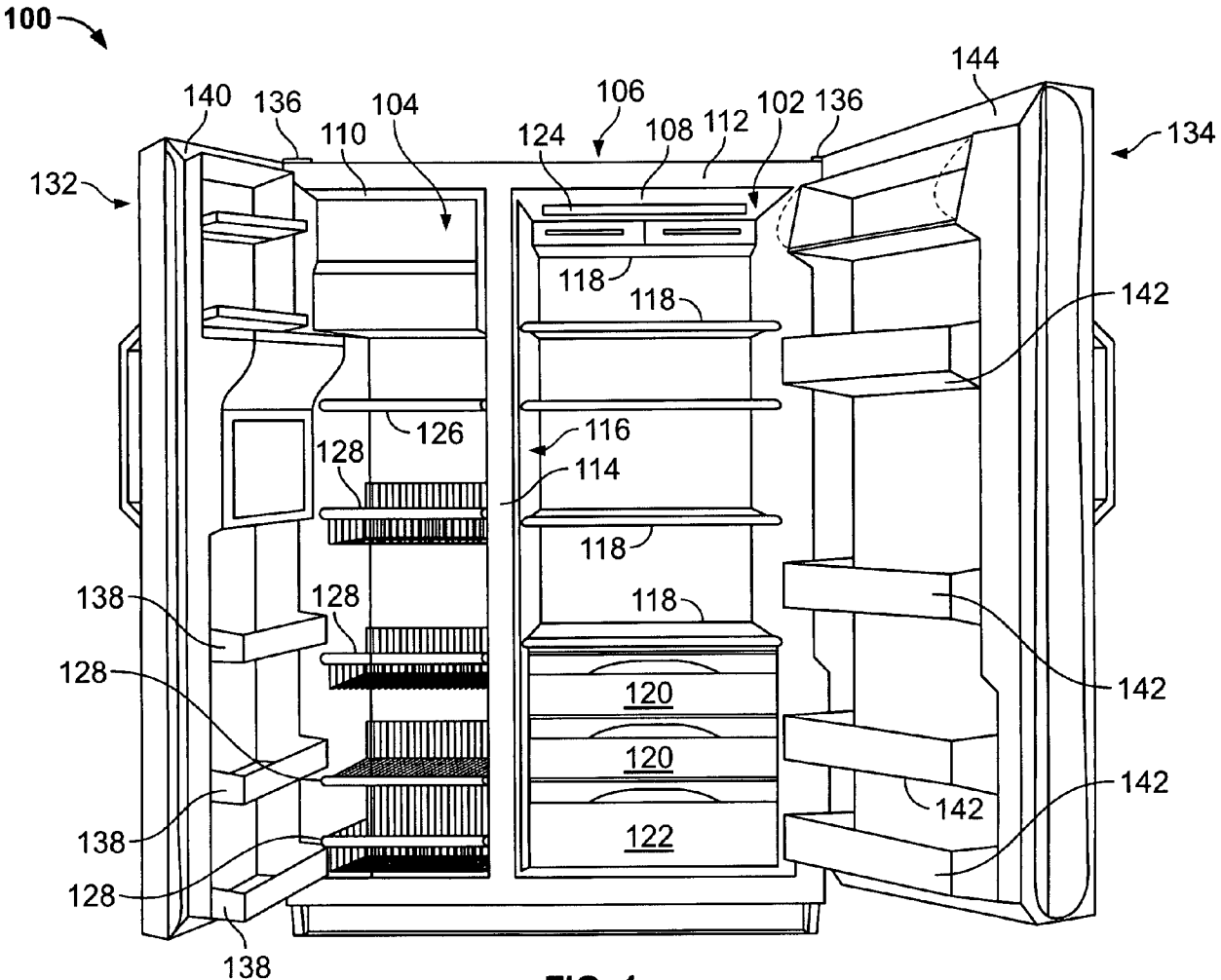
FIG. 1 is a perspective view of an exemplary appliance.

FIG. 1 is a perspective view of an exemplary appliance 100 in which exemplary embodiments of the present invention may be practiced and for which the benefits of the invention may be realized. Appliance 100 is a known-type of household or commercial grade appliance having support members for carrying or supporting items such as, but not limited to, shelves, drawers, bins, chambers, containers, and the like. Examples of appliance 100 include a refrigerator, a freezer, a dishwashing appliance, a cooking appliance, a wine vault, and the like. While appliance 100 is described and illustrated as a refrigerator 100, it is appreciated that the herein described methods and apparatus may likewise be practiced in a variety of different types of appliances 100 with modification apparent to those in the art. Therefore, refrigerator 100 as described and illustrated herein is for illustrative purposes only and is not intended to limit the herein described methods and apparatus in any aspect.

FIG. 1 illustrates a side-by-side refrigerator 100 including a fresh food storage compartment 102 and freezer storage compartment 104. Freezer compartment 102 and fresh food compartment 104 are arranged side-by-side. A side-by-side refrigerator similar to refrigerator 100 is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 106, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-syrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing an unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. Refrigerator 100 also includes a bottom pan 122 that may be a part of a quick chill and thaw system (not shown in FIG. 1) that is selectively controlled, together with other refrigerator features, by a microprocessor (not shown in FIG. 1) according to user preference via manipulation of a control interface 124 mounted in an upper region of fresh food storage compartment 102 and coupled to the microprocessor. Shelves 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
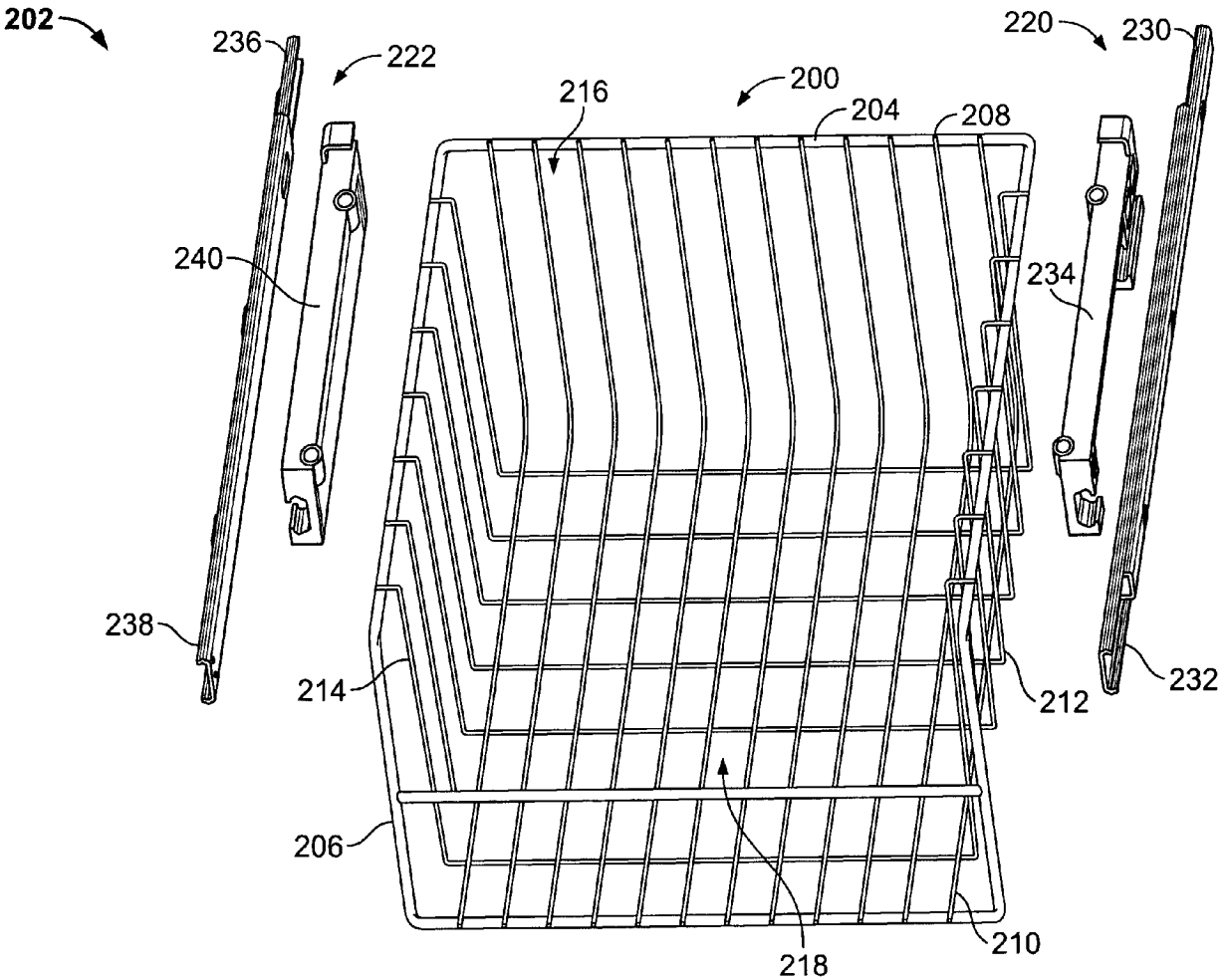
FIG. 2 is an exploded perspective view of an exemplary storage member and an exemplary support assembly for the appliance shown in FIG. 1.

FIG. 2 is an exploded perspective view of an exemplary storage member 200 and an exemplary support assembly 202 for appliance 100 (shown in FIG. 1). Examples of storage member 200 include a shelf, a wire basket, a bin, a drawer, a container, and the like. While storage member 200 is described and illustrated hereinafter as a wire basket such as wire basket 128 (shown in FIG. 1), it is appreciated that the herein described methods and apparatus may likewise be practiced in a variety of different types of storage members 200 with modification apparent to those in the art. Therefore, storage member 200 as described and illustrated herein is for illustrative purposes only and is not intended to limit the herein described methods and apparatus in any aspect.

Storage member 200 includes a frame 204 having a front 206, a back 208, a bottom 210, a first side 212 and a second side 214. A top 216 of storage member 200 is open for accessing a storage chamber 218 of storage member 200 defined by frame 204. Front 206 is at least partially open to allow access to storage chamber 218. In the exemplary embodiment, frame 204 defines a box-shaped storage chamber 218 for supporting items to be held within appliance 100.

Support assembly 202 is provided to support storage member 200. Support assembly 202 includes a first slide sub-assembly 220 and a second slide sub-assembly 222. Each slide sub-assembly 220 and 222 includes slides or rails that facilitate moving storage member 200 between a retracted position and an extended position. In the retracted position, storage member 200 is received within compartment 104 (shown in FIG. 1) of appliance 100. In the extended position, storage member 200 is slid at least partially out of compartment 104 for easy access to the items stored by storage member 200. First and second slide sub-assemblies 220 and 222 cooperate to support first side 212 and second side 214, respectively, of storage member 200. Additionally, first and second slide sub-assemblies 220 and 222 are operated in unison to facilitate movement of storage member 200 between the retracted and extended positions.

In the exemplary embodiment, first slide sub-assembly 220 includes a first inner or fixed rail 230, a first outer or movable rail 232 and a first bracket 234. Fixed rail 230 and movable rail 232 are fabricated from a durable material, such as metal, to withstand the forces and weight of supporting storage member 200. Bracket 234 is fabricated from a different material than fixed rail 230 and movable rail 232. In the exemplary embodiment, bracket 234 is fabricated from a plastic material. In the exemplary embodiment, a lubricant coating is applied to at least one of bracket 234 and movable rail 232 to facilitate movement of bracket 234 with respect to movable rail 232. Second slide sub-assembly 222 is substantially similar to first slide sub-assembly 220 and includes a second inner or fixed rail 236, a second outer or movable rail 238 and a second bracket 240. As first and second slide sub-assemblies 220 and 222, respectively, are substantially similar, the remainder of the disclosure will discuss the features and operations of support assembly 202 in terms of and with respect to first slide sub-assembly 220. It should be understood that second slide sub-assembly 222 includes similar features and operates in a similar manner as first slide sub-assembly 220.

Figure 3:
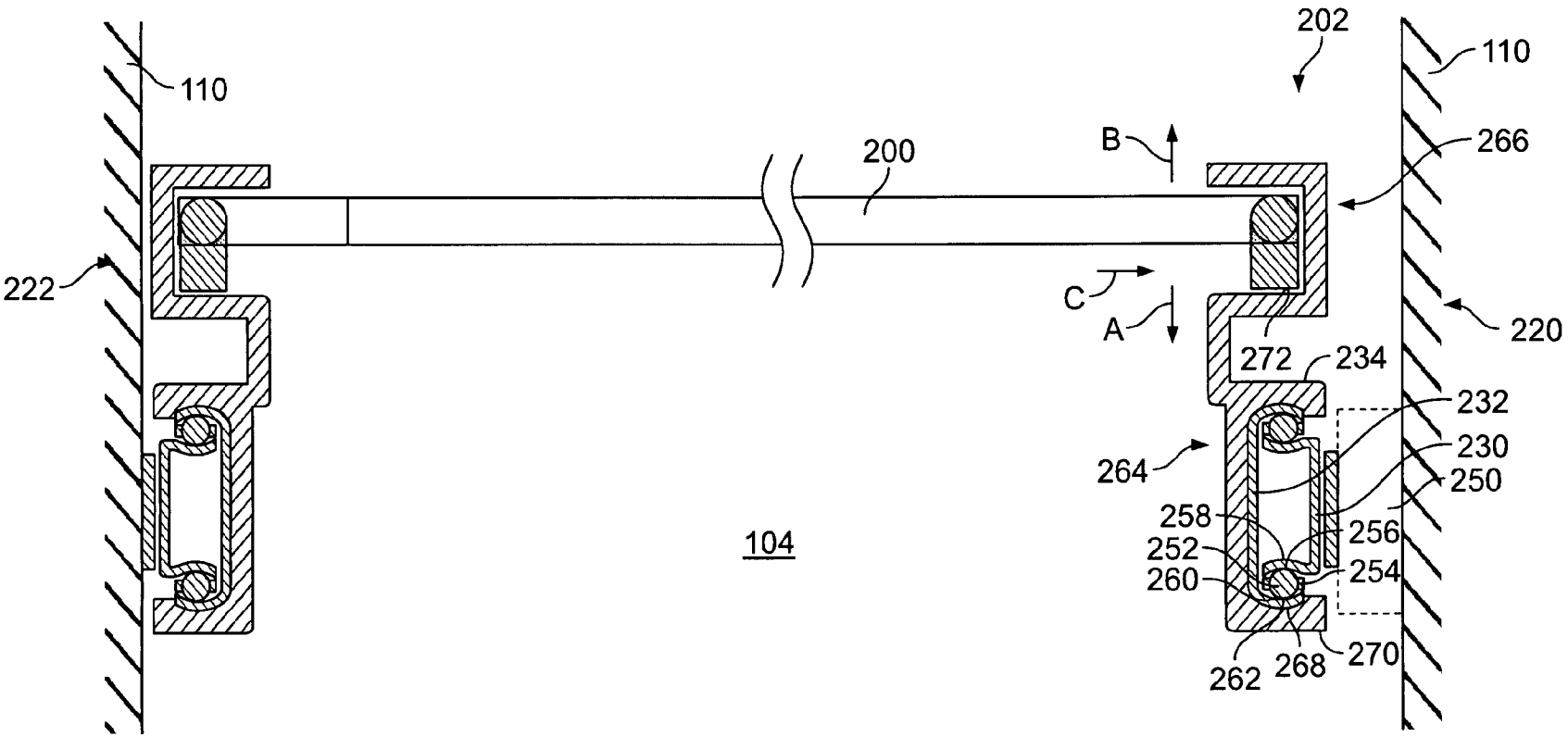
FIG. 3 is a cross-sectional view of the storage member and support assembly shown in FIG. 2.

FIG. 3 is a cross-sectional view of storage member 200 and support assembly 202. As illustrated in FIG. 3, fixed rail 230 is mounted to inner liner 110 of compartment 104. In one embodiment, a spacer 250 is placed between fixed rail 230 and inner liner 110 to properly position first slide sub-assembly 220 within compartment 104, or to properly space first slide sub-assembly 220 with respect to second slide sub-assembly 222. In the exemplary embodiment, fixed rail 230 is coupled to inner liner 110 using a fastener (not shown), such as a screw. As such, the position of fixed rail 230 with respect to inner liner 110 is fixed.

Movable rail 232 is slidably mounted to fixed rail 230. In the exemplary embodiment, a plurality of ball bearings 252 are positioned between fixed rail 230 and movable rail 232, and ball bearings 252 are held within a frame 254. Frame 254 maintains spacing and positioning between ball bearings 252. In the exemplary embodiment, a lubricant coating is applied to at least one of fixed rail 230, movable rail 232, and ball bearings 252.

Fixed rail 230 includes an inner surface 256 and an outer surface 258. Outer surface 258 faces inner liner 110 and is mounted to inner liner 110. Outer surface 258 also faces movable rail 232. Movable rail 232 includes an inner surface 260 and an outer surface 262. Inner surface 260 faces fixed rail 230 and outer surface faces bracket 234. In the exemplary embodiment, ball bearings 252 are snuggly fit between a track defined by outer surface 258 of fixed rail 230 and a track defined by inner surface 260 of movable rail. The tracks are defined by radiused surfaces of fixed rail 230 and movable rail 232. The cooperation between the tracks and ball bearings 252 facilitate coupling movable rail 232 to fixed rail 230.

Bracket 234 includes a base portion 264 that is mounted to movable rail 232 and a hook portion 266 extending from base portion 264. Bracket 234 includes an inner surface 268 facing outer surface 262 of movable rail 232 and facing inner liner 110. Bracket also includes an outer surface 270 facing storage member 200. A portion of outer surface 270 defines a supporting surface 272 for engaging and supporting storage member 200. Supporting surface 272 is substantially planar, and in the exemplary embodiment, is oriented substantially horizontally when assembled. Hook portion 266 is L-shaped and extends upward from supporting surface 272. As such, hook portion 266 and support surface 272 define a channel for supporting and retaining storage member 200 therein. For example, supporting surface 272 resists movement of storage member 200 in a generally vertically downward direction, such as in the direction of arrow A. Hook portion 266 resists movement of storage member 200 in a generally vertically upward direction, such as in the direction of arrow B. Hook portion 266 also resist outward movement of storage member 200 toward inner liner 110, such as in the direction of arrow C.

Figure 4:
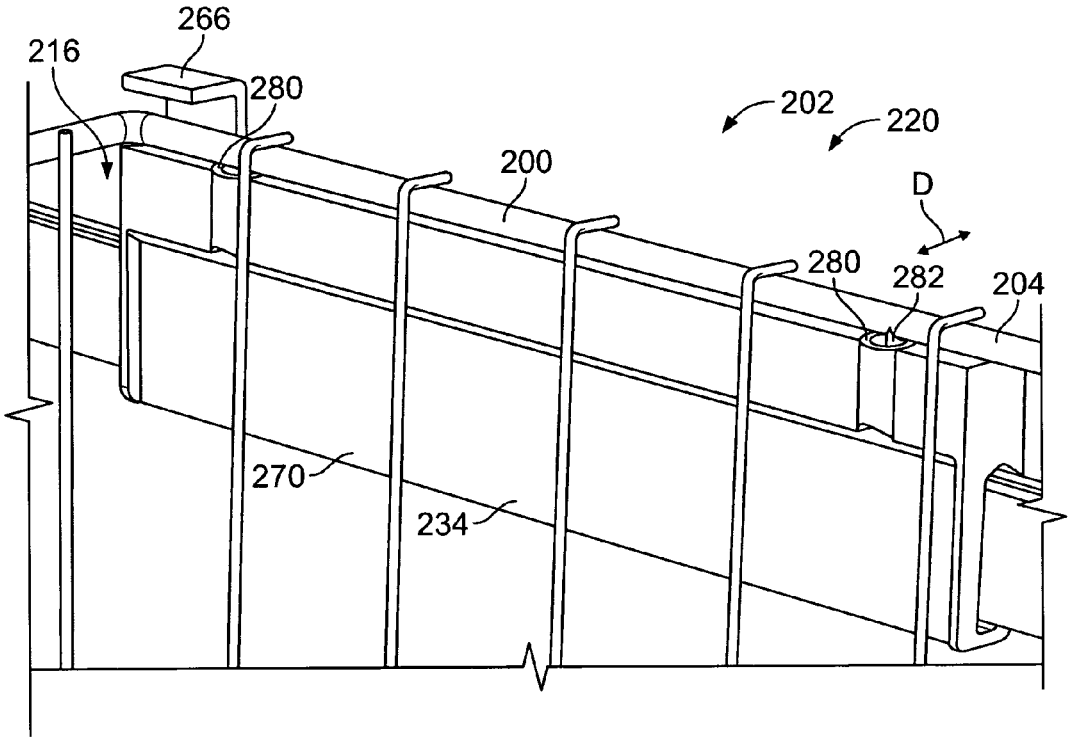
FIG. 4 is a front perspective view of a portion of the storage member and support assembly shown in FIG. 2.
Figure 5:
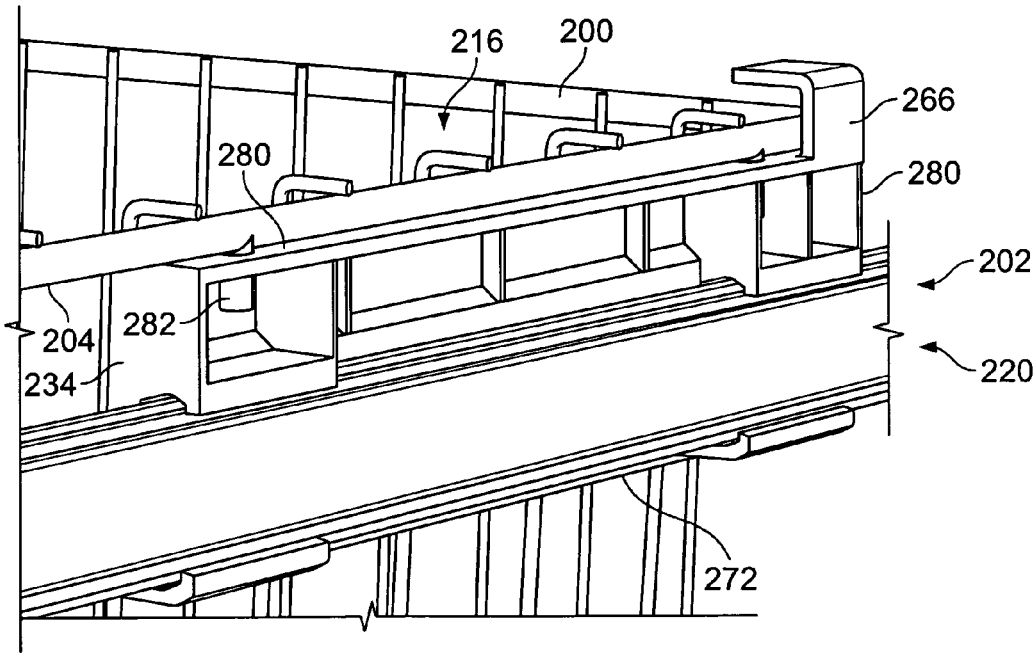
FIG. 5 is a rear perspective view of a portion of the storage member and support assembly shown in FIG. 2.

FIGS. 4 and 5 are front and rear perspective views, respectively, of a portion of storage member 200 and support assembly 202. As illustrated in FIGS. 4 and 5, storage member 200 rests upon supporting surface 272 of bracket 234. In the exemplary embodiment, a plurality of openings 280 extend through supporting surface 272. As best illustrated in FIG. 4, openings 280 are elongated and oval-shaped in a direction extending generally between outer surface 270 and inner surface 272, such as in the direction of arrow D.

As best illustrated in FIG. 5, storage member 200 includes tabs 282 extending from frame 204 proximate top 216 of storage member 200. Tabs 282 are received within corresponding openings 280 to join storage member 200 to bracket 234 of support assembly 202. As such, during use, storage member 200 and bracket 234 move in unison with one another. In the exemplary embodiment, tabs 282 have a circular cross-section and are sized to fit within openings 280 to resist movement of tabs 282 in a direction parallel to a direction of movement of storage member 200 and bracket 234. Because openings 280 are elongated, tabs 282 are able to move within openings 280 in the direction of elongation. As such, storage member 200 is able to move relatively closer to either first slide sub-assembly 220 or second slide sub-assembly 222 (shown in FIG. 2). Additionally, openings 280 accommodate for variations in the orientation of inner liner 110 (shown in FIGS. 1 and 3) with respect to compartment 104 (shown in FIG. 1) or for variations within the inner liner 110 itself, such as non-planar or curved surfaces. For example, if first slide sub-assembly 220 is oriented non-parallel to second slide sub-assembly 222 due to variations in inner liners 110, then storage member 200 is still readily coupled to first slide sub-assembly 220 and second slide sub-assembly 222. Additionally, openings 280 allow storage member 200 to be oriented in a non-orthogonal orientation with respect to first slide sub-assembly 220 or second slide sub-assembly 222. Bracket 234 includes supporting ribs 284 that provide rigidity to bracket 234 but reduce an overall amount of material, and thus cost, of bracket 234.

As further illustrated in FIGS. 4 and 5, hook portion 266 extends upward from supporting surface 272 and defines a stop for unwanted or inadvertent removal of storage member 200 from support assembly 202. For example, hook portion 266 resists upward movement, outward movement, and rotational movement of storage member 200 with respect to first slide sub-assembly 220. In the exemplary embodiment, hook portion 266 is positioned a distance from support member 200 to allow controlled removal of storage member 200 from first slide sub-assembly 220. For example, hook portion 266 is positioned a greater distance from support member 200 than a length of tabs 282 to allow tabs 282 to be completely removed from openings 280 for removal of storage member 200 from bracket 234.

Figure 6:
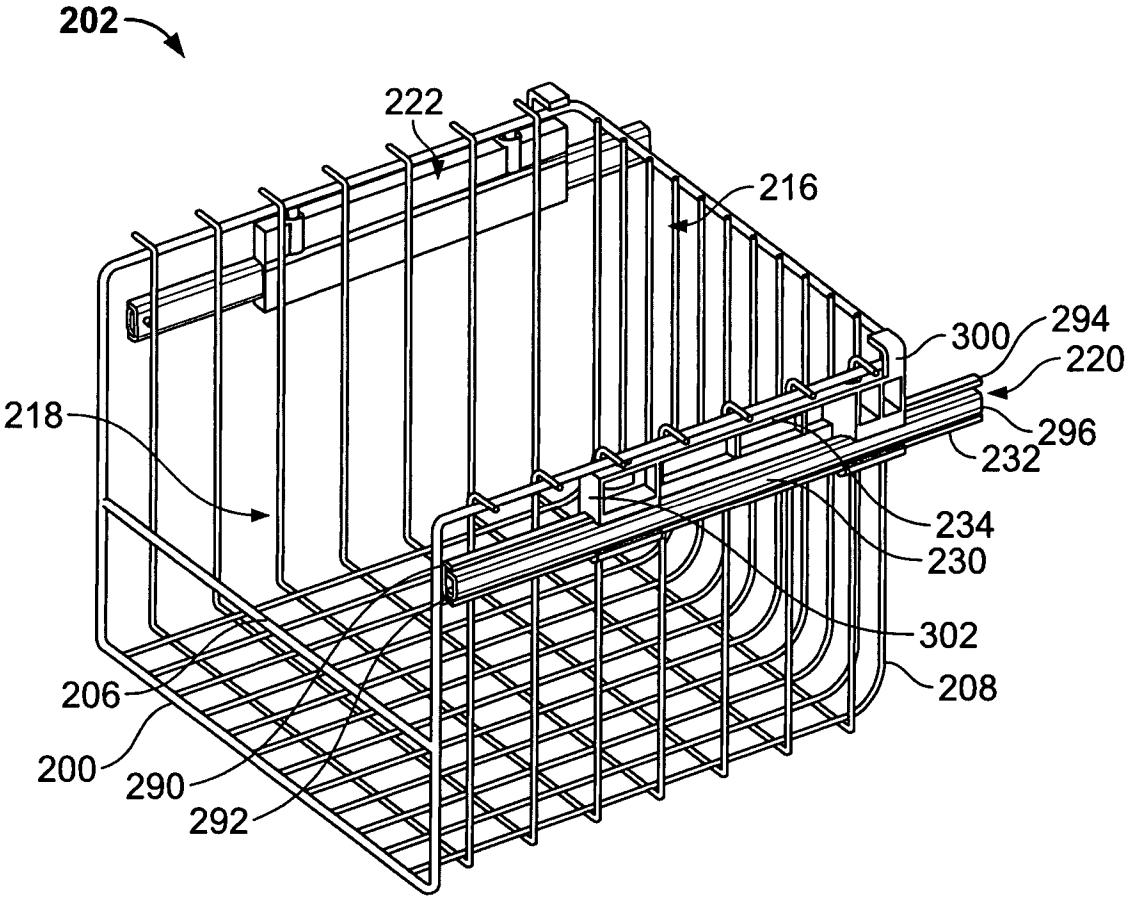
FIG. 6 is a perspective view of the storage member and support assembly shown in a retracted position.
Figure 7:
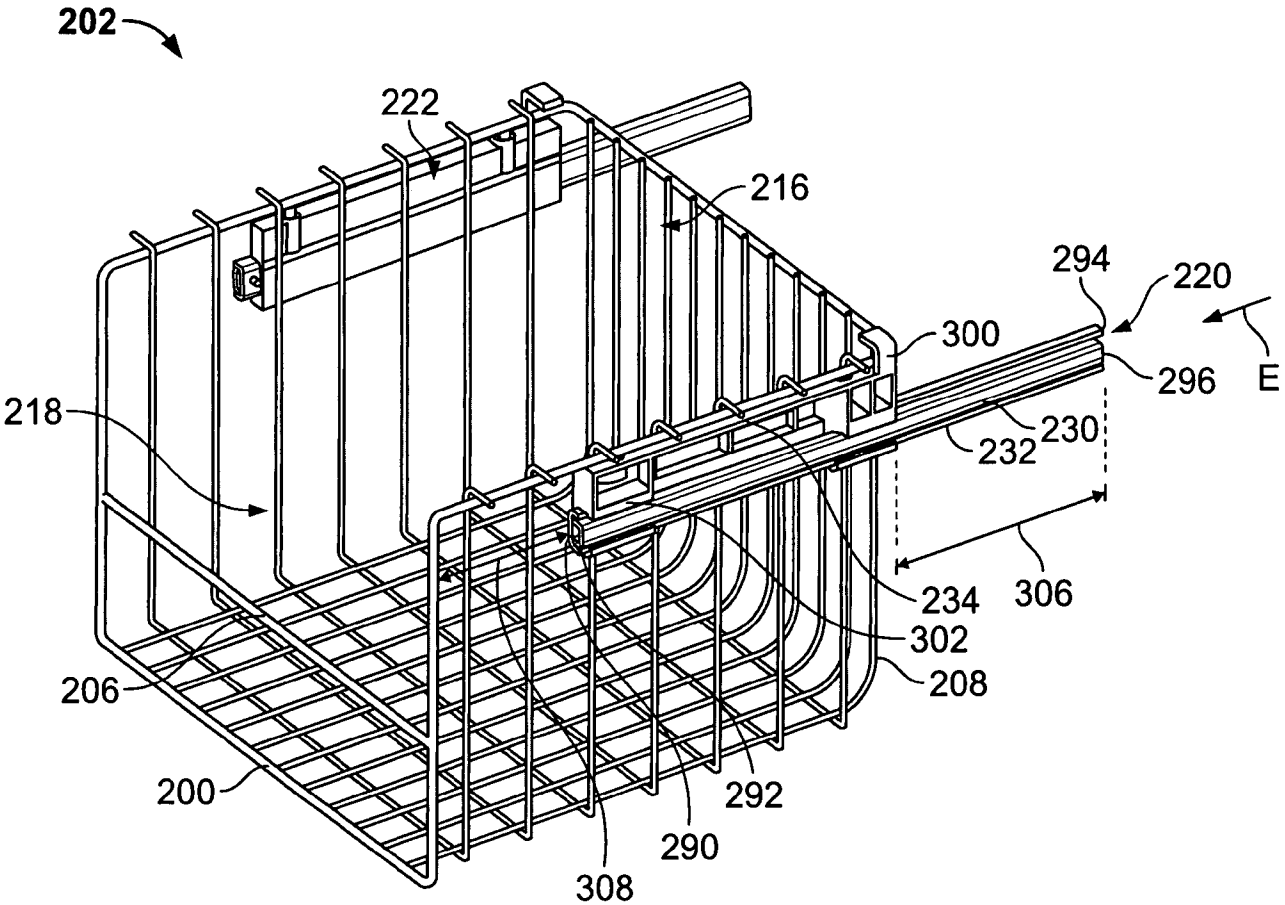
FIG. 7 is a perspective view of the storage member and support assembly shown in a partially extended position.
Figure 8:
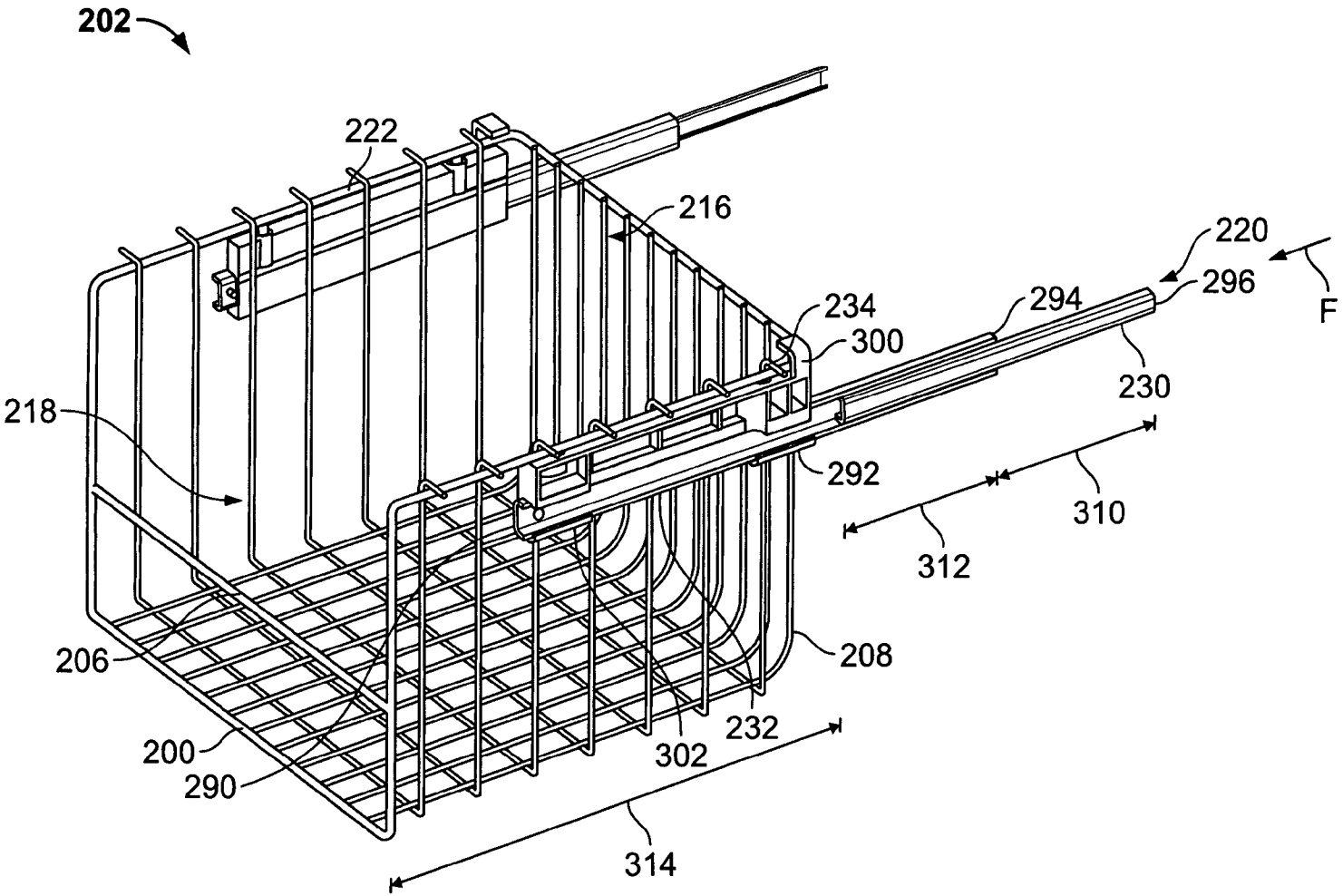
FIG. 8 is a perspective view of the storage member and support assembly shown in a fully extended position.

A range of motion of storage member 200 and support assembly 202 is illustrated with reference to FIGS. 6-8. FIG. 6 is a perspective view of storage member 200 and support assembly 202 shown in a closed or retracted position. FIG. 7 is a perspective view of storage member 200 and support assembly 202 shown in a partially opened or partially extended position. FIG. 8 is a perspective view of storage member 200 and support assembly 202 shown in a fully opened or fully extended position.

As illustrated in FIG. 6, storage member 200 is in a closed position. In the closed position, storage member 200 is contained within compartment 104 (shown in FIG. 1) such that door 132 (shown in FIG. 1) may be closed. In the closed position, items stored by storage member 200 are accessible through front 206. Typically, another shelf or basket is positioned generally vertically above storage member 200 when assembled within appliance 100 such that items stored by storage member 200 are not accessible through top 216 when storage member 200 is in the closed position. In the exemplary embodiment, back 208 is positioned adjacent inner liner 110 (shown in FIG. 1) when storage member 200 is in the closed position and front 206 is positioned adjacent door 132. As such, storage member 200 substantially fills the depth of compartment 104 to maximize storage space of compartment 104.

As further illustrated in FIG. 6, support assembly 202 is in a retracted position. With reference to first slide sub-assembly 220, movable rail 232 is at a rearward-most position with respect to fixed rail 230 when in the retracted position. A front end 290 of movable rail 232 is substantially aligned with a front end 292 of fixed rail 230. A rear end 294 of movable rail 232 is substantially aligned with a rear end 296 of fixed rail 230. In the exemplary embodiment, movable rail 232 engages a stopper (not shown) extending from fixed rail 230 to stop movement of movable rail 232 toward rear end 296 of fixed rail 230. In the exemplary embodiment, rear end 296 of fixed rail 230 is positioned adjacent inner liner 110 and front end 292 of fixed rail 230 is positioned adjacent an outer end of inner liner 110 proximate the opening for door 132. As such, fixed rail 230 has a length that allows for full movement of movable rail 232.

Bracket 234 is at a rearward-most position with respect to movable rail 232 when in the retracted position. A rear end 300 of bracket 234 is positioned proximate rear end 294 of movable rail 232. A front end 302 of bracket 234 is positioned remote with respect to front end 290 of movable rail 232. In the exemplary embodiment, bracket 234 engages a stopper (not shown) extending from movable rail 232 to stop movement of bracket 234 toward rear end 294 of movable rail 232. In the exemplary embodiment, front 206 of storage member 200 is substantially aligned with front end 292 of fixed rail 230.

Turning to FIG. 7, storage member 200 is illustrated in a partially open position. In the partially open position, storage member 200 is partially exposed outside compartment 104 such that items stored by storage member 200 are accessible. In the partially open position, items stored by storage member 200 are accessible through front 206 and through a portion of top 216.

As further illustrated in FIG. 7, support assembly 202 is in a partially extended position. With reference to first slide sub-assembly 220, movable rail 232 is at a rearward-most position with respect to fixed rail 230 when in the partially extended position. Front end 290 of movable rail 232 is substantially aligned with front end 292 of fixed rail 230. Rear end 294 of movable rail 232 is substantially aligned with rear end 296 of fixed rail 230. Moreover, bracket 234 is at a forward-most position with respect to movable rail 232 when in the partially extended position. Rear end 300 of bracket 234 is positioned remote with respect to rear end 294 of movable rail 232. Front end 302 of bracket 234 is positioned proximate front end 290 of movable rail 232. As such, in the partially extended position, fixed rail 230 and movable rail 232 are in a retracted position with respect to one another and bracket 234 and movable rail 232 are in an extended position with respect to one another. In operation, when support assembly 202 is moved from the retracted position to the partially extended position, bracket 234 is slid a distance 306 to an extended position along movable rail 232 in a linear sliding direction, shown by arrow E. In the exemplary embodiment, front 206 of storage member 200 is positioned a distance 308 from front end 292 of fixed rail 230 such that storage chamber 218 is partially accessible through top 216. Distance 308 is substantially equal to distance 306.

In an alternative embodiment, in the partially extended position, movable rail 232 is moved with respect to fixed rail 230 to an extended position and bracket 234 remains in the retracted position with respect to movable member 232. As such, one of movable rail 232 and bracket 234 are movable from a retracted position to an extended position as support assembly 200 is moved from the retracted position to the partially extended position. In another alternative embodiment, both movable rail 232 and bracket 234 are moved from respective retracted positions to partially extended positions as support assembly 200 is moved from the retracted position to the partially extended position.

Turning to FIG. 8, storage member 200 is illustrated in a fully open position. In the fully open position, storage member 200 is exposed outside compartment 104 such that items stored by storage member 200 are accessible. In the fully open position, items stored by storage member 200 are accessible through front 206 and through top 216.

As further illustrated in FIG. 8, support assembly 202 is in a fully extended position. With reference to first slide sub-assembly 220, movable rail 232 is at a forward-most position with respect to fixed rail 230 when in the fully extended position. Front end 290 of movable rail 232 is positioned remote with respect to front end 292 of fixed rail 230. Rear end 294 of movable rail 232 is positioned remote with respect to rear end 296 of fixed rail 230. Moreover, bracket 234 is at a forward-most position with respect to movable rail 232 when in the fully extended position. Rear end 300 of bracket 234 is positioned remote with respect to rear end 294 of movable rail 232. Front end 302 of bracket 234 is positioned proximate front end 290 of movable rail 232. As such, in the fully extended position, movable rail 232 and bracket 234 are both in extended positions. In operation, movable rail 232 is slid a distance 310 to the extended position along fixed rail 230 in a linear sliding direction, shown by arrow F. Distance 310 is less than a length of fixed rail 230 or movable rail 232 such that an overlap 312 exists between fixed rail 230 and movable rail 232. Overlap 312 provides stability to first slide sub-assembly 220. In the exemplary embodiment, front 206 of storage member 200 is positioned a distance 314 from front end 292 of fixed rail 230. Distance 314 is substantially equal to a sum of distances 306 and 310. In the exemplary embodiment, distance 314 is greater than or equal to a length of storage member 200 such that back 208 of storage member 200 is extended at least to a position at front end 292 of fixed rail 230. As such, the entire top 216 is exposed for accessing items stored by storage member 200.

Figure 9:
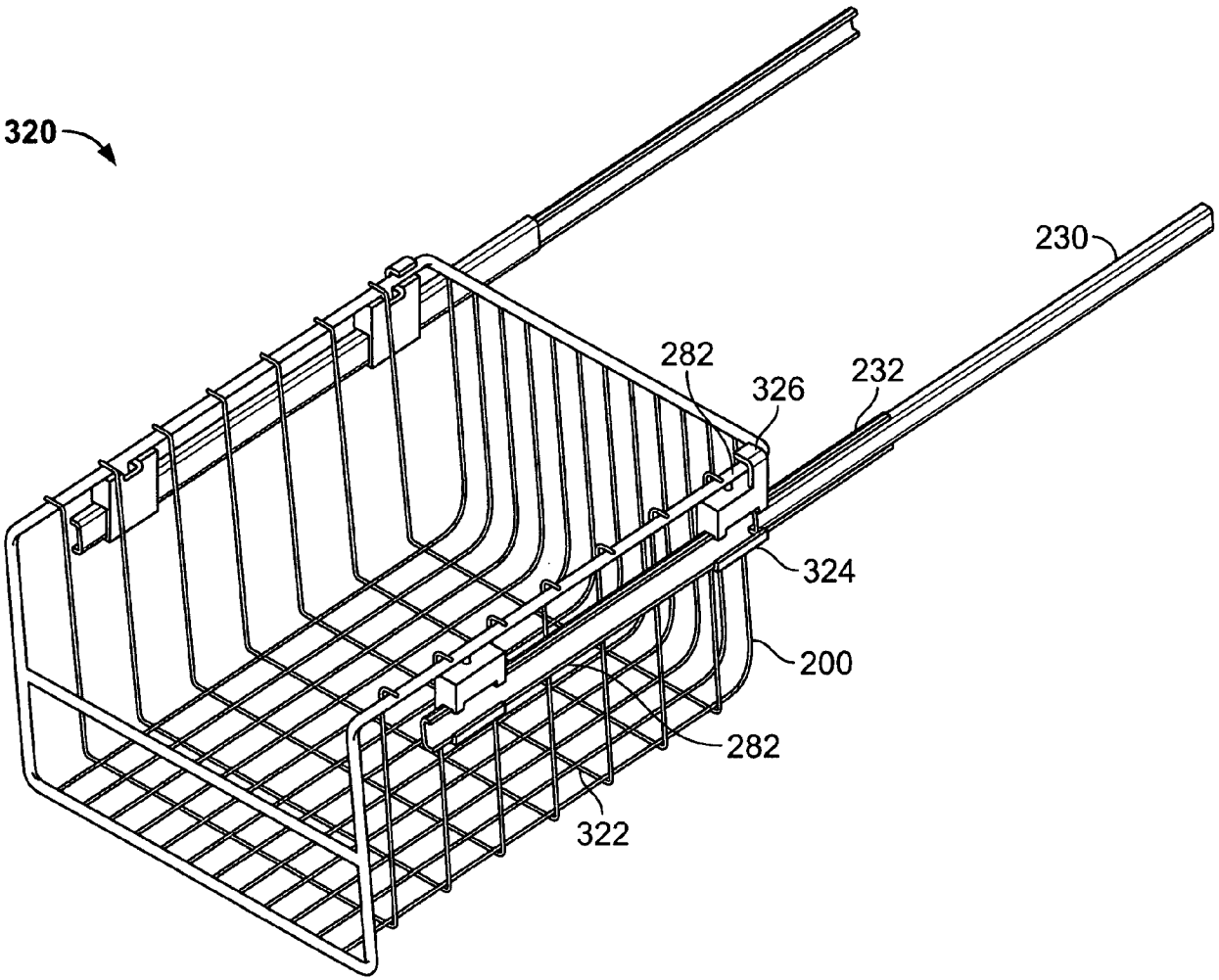
FIG. 9 is a perspective view of an alternative support assembly for the storage member shown in FIG. 2.

FIG. 9 is a perspective view of an alternative support assembly 320 for storage member 200. Support assembly 320 is substantially similar to support assembly 202, and as such, like reference numerals are used to identify like components. Support assembly 320 includes fixed rail 230, movable rail 232, a forward bracket 322 and a rear bracket 324. As opposed to the single bracket 234 (shown in FIGS. 2-8), support assembly 320 includes a dual bracket structure. Forward bracket 322 and rear bracket 324 are independently mounted to movable rail 232 and are slidable along movable rail 232. Storage member 200 is joined to both forward bracket 322 and rear bracket 324 via tabs 282. In the exemplary embodiment, rear bracket 324 includes a hook portion 326.

A storage member and support assembly for an appliance is thus provided in a cost effective and reliable manner. The support assembly includes a fixed rail that is coupled to a wall of the appliance and a single movable rail that is slidably coupled to the fixed rail. To facilitate full extension of the storage member, and thus provide easier access to the items stored by the storage member, a bracket is slidably coupled to the movable member. The bracket is movable over a distance that is substantially equal to the amount of overlap between fixed rail and movable rail when the rails are in the extended position. As such, the support assembly allows for full extension of a two rail system, wherein the full extension exposes the entire top of storage member when extended. By using a two rail system as opposed to a three rail system, considerable cost savings are provided to the overall support assembly. Additionally, by providing full extension, access to the entire storage member is provided which is desirable for the consumer and increases the sale point of the appliance.

While the invention has been described in terms of various specific embodiments, those skilled in the art will recognize that the invention can be practiced with modification within the spirit and scope of the claims.

What is claimed is:

1. An appliance comprising:

a cabinet having a plurality of cabinet walls defining a compartment;

a storage member configured to support an item for storage in said compartment, said storage member comprising a plurality of side walls defining a storage compartment, a top portion of said storage member defining an opening to said storage compartment;

a support assembly slidably mounted within said compartment, said support assembly comprising a fixed rail mounted to one of said cabinet walls, and a movable rail slidably coupled to said fixed rail and movable along a sliding direction between a retracted position and an extended position; and a bracket slidably mounted to and in direct contact with said movable rail, the bracket being movable along a sliding direction between a retracted position and an extended position, the sliding direction of said bracket substantially parallel to the sliding direction of said movable rail, wherein said storage member is fixedly connected to said bracket and movable with said bracket, and wherein said bracket comprises a support surface configured to support said top portion of said storage member thereon, said bracket further comprising a hook disposed above said fixed rail and extending above said support surface and said top portion of said storage member such that at least a portion of said top portion of said storage member is at least partially positionable between said support surface and said hook, said hook configured to resist removal of said storage member from said bracket.

2. An appliance in accordance with claim 1 wherein said storage member is positionable in a closed position wherein said storage member is positioned within said compartment, and said storage member is positionable in a fully opened position wherein said storage member is at least partially positioned outside of said compartment for accessing the item, wherein said movable rail is in the retracted position and said bracket is in the retracted position when said storage member is in the closed position, and wherein said movable rail is in the extended position and said bracket is in the extended position when said storage member is in the opened position.

3. An appliance in accordance with claim 2 wherein said storage member is positionable in a partially opened position when one of said movable rail and said bracket is in the retracted position and the other of said movable rail and said bracket is in the extended position.

4. An appliance in accordance with claim 1 wherein an inner surface of said bracket is slidable along an outer surface of said movable rail, said appliance further comprising a lubricant coating at least one of said inner surface of said bracket and said outer surface of said movable rail.

5. An appliance in accordance with claim 1 wherein said fixed rail and said movable rail are metal and said bracket is plastic.

6. An appliance in accordance with claim 1 wherein said storage member comprises at least one of a shelf, a wire basket, a bin and a drawer.

7. An appliance in accordance with claim 1 wherein said bracket comprises a forward bracket and a rear bracket separately provided from one another, both of said forward and rear brackets are mounted to said movable rail, with said hook being provided on said rear bracket.

8. An appliance in accordance with claim 1 wherein said movable rail has a first length and said bracket has a second length, said first length longer than said second length such that said bracket is slidable along said movable rail.

9. The appliance of claim 1, wherein the bracket is a single piece member coupled between the movable rail and the storage member.

10. The appliance of claim 1, wherein the bracket includes an upper arm and a lower arm, the upper arm slidably coupled to a top portion of the movable rail and the lower arm slidably coupled to a bottom portion of the movable rail.

11. The appliance of claim 1, the bracket comprising an inner surface and an outer surface, the inner surface of the bracket facing the outer surface of the fixed rail and the outer surface of the bracket facing, and in direct contact with, the storage member, a portion of the outer surface of the bracket defining the supporting surface; and the movable rail comprising an inner surface and an outer surface, the inner surface facing the fixed rail and the outer surface facing, and in direct contact with, the bracket.

12. The appliance of claim 1, the storage member comprising a tab extending from the top portion of the storage member, the tab configured to be received in an opening in the support surface of the bracket to fixedly connect the storage member to the bracket.

13. The appliance of claim 12, wherein the tabs are circular in cross-section and the openings in the support surface are elongated and oval shaped.

14. A support assembly for a storage member of an appliance having a cabinet with a plurality of cabinet walls defining a compartment, the storage member configured to store an item in the compartment, said storage member comprising a plurality of side walls defining a storage compartment, a top portion of said storage member defining an opening to said storage compartment, said support assembly comprising:

a fixed rail mounted to one of the cabinet walls;

a movable rail slidably coupled to said fixed rail and movable along a sliding direction between a retracted position and an extended position; and a bracket slidably mounted to and in direct contact with said movable rail and movable along a sliding direction between a retracted position and an extended position, the sliding direction of said bracket substantially parallel to the sliding direction of said movable rail, said bracket configured to directly contact and support the storage member such that the storage member is movable with said bracket, wherein said bracket comprises a support surface configured to support said top portion of said storage member thereon, said bracket further comprising a hook disposed above said fixed rail and extending above said support surface and said top portion of said storage member such that at least a portion of said top portion of said storage member is at least partially positionable between said support surface and said hook, said hook configured to resist removal of said storage member from said bracket.

15. A support assembly in accordance with claim 14 wherein said storage member is positionable in a closed position wherein said storage member is positioned within said compartment, and said storage member is positionable in a fully opened position wherein said storage member is at least partially positioned outside of said compartment for accessing the item, wherein said movable rail is in the retracted position and said bracket is in the retracted position when said storage member is in the closed position, and wherein said movable rail is in the extended position and said bracket is in the extended position when said storage member is in the opened position.

16. A support assembly in accordance with claim 14 wherein an inner surface of said bracket is slidable along an outer surface of said movable rail, said appliance further comprising a lubricant coating at least one of said inner surface of said bracket and said outer surface of said movable rail.

17. An appliance in accordance with claim 14 wherein said bracket comprises a forward bracket and a rear bracket separately provided from one another, both of said forward and rear brackets are mounted to said movable rail, with said hook being provided on said rear bracket.

18. A support assembly in accordance with claim 14 wherein said movable rail has a first length and said bracket has a second length, said first length longer than said second length such that said bracket is slidable along said movable rail.

* * * * *